US005683022A

United States Patent [19]

Evans

[11] Patent Number: 5,683,022

[45] Date of Patent: Nov. 4, 1997

[54] MULTI-POUCH BELT

[76] Inventor: Chuck A. Evans, 743 Wilson Blvd., Central Islip, N.Y. 11722

[21] Appl. No.: 537,637

[22] Filed: Oct. 2, 1995

[51] Int. Cl.[6] ..... A45F 5/00

[52] U.S. Cl. ..... 224/583; 224/587; 224/672; 224/901.08

[58] Field of Search ..... 224/582, 583, 224/587, 660, 671, 672, 682, 901, 901.04, 901.08

[56] References Cited

U.S. PATENT DOCUMENTS

| | | | |
|---|---|---|---|
| 2,321,808 | 6/1943 | Govan | 224/587 X |
| 4,907,729 | 3/1990 | Hess, III | 224/672 X |
| 4,957,231 | 9/1990 | Kalisher | 224/583 |
| 5,086,758 | 2/1992 | Schiek, Sr. et al. | 602/19 |
| 5,121,865 | 6/1992 | Howard | 224/253 |
| 5,143,371 | 9/1992 | Strahan | 273/32 B |
| 5,152,443 | 10/1992 | Hagan | 224/252 |
| 5,201,447 | 4/1993 | Bumb et al. | 224/243 |
| 5,240,156 | 8/1993 | Sicotte et al. | 224/583 |
| 5,464,136 | 11/1995 | Eddy | 224/901.8 |
| 5,497,923 | 3/1996 | Pearson et al. | 224/682 X |

*Primary Examiner*—Renee S. Luebke
*Attorney, Agent, or Firm*—Richard L. Miller, P.E.

[57] ABSTRACT

A multi-pouch belt that includes a belt, a belt strap, a pouch strap, and at least one pouch/holder. The belt is manufactured in a variety of colors from canvas or leather and is adjustable and waterproof and has an inner side that contains a zippered pouch for holding paper money, an outer side, a first free end, and a second free end. The belt strap is disposed on the outer side of the belt and has a part of hook and loop fasteners disposed thereon. The pouch strap has a part of hook and loop fasteners disposed thereon that is complementary to and releasibly engagable with the part of hook and loop fasteners of the belt strap. Each pouch/holder is removably mounted on the pouch strap and has a loop disposed thereon that removably receives the pouch strap. Each pouch/holder is manufactured in a variety of colors from canvas or leather and is waterproof. The pouch/holder may include a cigarette lighter holder, a lipstick holder, a snapable cigarette pouch, a snapable cosmetic makeup-up pouch, a flashlight holder, and/or a pen holder. A part of hook and loop fasteners is disposed on the inner surface of the loop that is complementary to the pouch strap part of hook and loop fasteners and releasibly engagable therewith and a part of hook and loop fasteners is disposed on the outer surface of the loop that is complementary to the belt strap part of hook and loop fasteners and releasibly engagable therewith so that the pouch/holder is further retained in a desired position.

10 Claims, 1 Drawing Sheet

MULTI-POUCH BELT

BACKGROUND OF THE INVENTION

The present invention relates to a utility belt. More particularly, the present invention relates to a utility belt utilizing VELCRO(R) hook and loop fasteners having an inside zippered pouch as well as a multitude of adjustable pouches.

People in general like to carry a lot of items with them. However, the needed space to carry these items can be a problem. Pockets in clothing cannot always provide the needed space. Ancillary cases such as pocket books or the like, however, could provide the needed space, but require holding by the user and can easily be removed.

Numerous innovations for belt holding devices have been provided in the prior art that will be described. However, even though these innovations may be suitable for the specific individual purposes to which they address, they differ from the present invention in that they do not teach a utility belt utilizing VELCRO(R) hook and loop fasteners having an inside zippered pouch as well as a plurality of removably mounted pouches.

For example, U.S. Pat. No. 5,086,758 to Schiek, Sr. et al. teaches a belt that includes a pair of straps. Each of the pair of straps has one of a complementary pair of pads of a hook and loop-type fastener system. A removable shield is placed over the surface of one of the pads.

Another example, U.S. Pat. No. 5,121,865 to Howard teaches a belt-carried holster that includes a slitted back plate engaged by a waist belt. Two pair of complementary hook and loop flexible fastener strips are connected to the back plate and interconnected in pairs in cross-over-lapping fashion, for containment of a cassette player against the back plate.

Still another example, U.S. Pat. No. 5,143,371 to Strahan teaches a golfer's aid that includes a body in the shape of a clip which can be attached to the belt, pocket or waistband of the user or to a golf bag or other article. A strip of hook and loop fabric is attached to the straight outer surface of the body for attaching the user's glove. A blade is rotatively attached to the end of the body.

Yet another example, U.S. Pat. No. 5,152,443 to Hagan teaches a multi-segmented utility belt that includes a plurality of substantially rigid sections connected by flexible portions. A variety of different tool holders can be pivotally and rotatively supported from the belt.

Finally, still yet another example, U.S. Pat. No. 5,201,447 to Bumb et al. teaches a holster for holding articles that is hooked over a user's belt. A pair of flexible straps permit various combinations of a hold-down for the article.

It is apparent that numerous innovations for belt holding devices have been provided in the prior art that are adapted to be used. Furthermore, even though these innovations may be suitable for the specific individual purposes to which they address, they would not be suitable for the purposes of the present invention as heretofore described.

SUMMARY OF THE INVENTION

A multi-pouch belt includes a belt, a belt strap, a pouch strap, and at least one pouch/holder. The belt is manufactured in a variety of colors from canvas or leather and is adjustable and waterproof and has an inner side that contains a zippered pouch for holding paper money, an outer side, a first free end, and a second free end. The belt strap is disposed on the outer side of the belt and has a loop part of hook and loop fasteners disposed thereon. The pouch strap has a hook part of hook and loop fasteners disposed thereon that is complementary to, and releasibly engageable with, the loop part of hook and loop fasteners of the belt strap. Each pouch/holder is removably mounted on the pouch strap and has a loop disposed thereon that removably receives the pouch strap. Each pouch/holder is manufactured in a variety of colors from canvas or leather and is waterproof. The pouch/holder may include a cigarette lighter holder, a lipstick holder, a snapable cigarette pouch, a snapable cosmetic makeup-up pouch, a flashlight holder, and/or a pen holder. A loop part of hook and loop fasteners is disposed on the inner surface of the loop that is complementary to the pouch strap hook part of hook and loop fasteners and is releasibly engageable therewith, so that the pouch/holder is releasibly retainable to the pouch strap. A hook part of hook and loop fasteners is disposed on the outer surface of the loop that is complementary to the belt strap loop part of hook and loop fasteners and is releasibly engageable therewith, so that the pouch/holder is releasibly retainable to the belt strap.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures on the drawing are briefly described as follows.

LIST OF REFERENCE NUMERALS UTILIZED IN THE DRAWING

Figure 1:
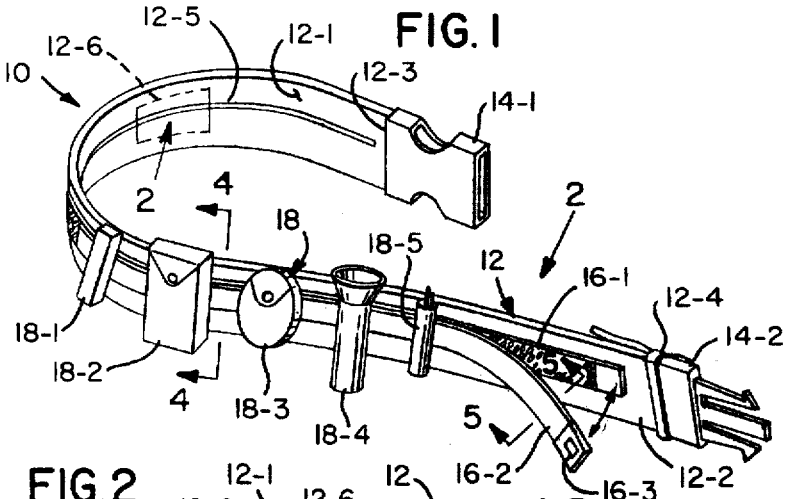
FIG. 1 is a diagrammatic perspective view of the instant invention.

10 multi-pouch belt of the present invention
12 belt
12-1 belt inner side
12-2 belt outer side 12-3 belt female buckle portion end
12-4 belt male buckle portion end
12-5 belt inner side zippered money pouch
12-6 paper money
12-7 belt inner side zippered money pouch slot
12-8 plastic belt inner side zippered money pouch slot zipper
14-1 plastic buckle female portion
14-2 plastic buckle male portion
16-1 belt strap with hook and loop fasteners
16-2 pouch strap with hook and loop fasteners
16-3 grabber tab
18 plurality of pouches and/or holders
18-1 cigarette lighter, a gum, or a lipstick holder
18-2 snapable cigarette pouch
18-3 snapable cosmetic makeup-up pouch
18-4 flashlight holder
18-5 pen holder
18-6 pouch and/or holder back loop
18-7 back loop outer surface strip of hook and loop fasteners
18-8 back loop inner surface strip of hook and loop fasteners

DETAILED DESCRIPTION OF THE PREFERRED EMBODIMENT

Referring now to the figures in which like numerals indicate like parts, and particularly to FIGS. 1–7, the multi-pouch belt of the present invention is shown generally at 10 including a belt 12 with a belt inner side 12-1 containing a belt inner side zippered money pouch 12-5, a belt outer side 12-2, a belt female buckle portion end 12-3, and a belt male buckle portion end 12-4. The belt 12 is adjustable and waterproof and can be manufactured in a variety of colors from canvas or leather.

A plastic buckle female portion 14-1 is disposed at the belt female buckle portion end 12-3 and a plastic buckle male portion 14-2 is disposed at the belt male buckle portion end 12-4 and is snapingly received by the plastic buckle female portion 14-1.

A belt strap with hook and loop fasteners 16-1 is disposed on the belt outer side 12-2 and a pouch strap with hook and loop fasteners 16-2 is complementary to and engagable with the belt strap with hook and loop fasteners 16-1. A grabber tab 16-3 is disposed at either or both ends of the pouch strap with hook and loop fasteners 16-2 to facilitate the engagement with or removal from the belt strap with hook and loop fasteners 16-1.

A plurality of pouches and/or holders 18 are removably mounted on the pouch strap with hook and loop fasteners 16-2 and are waterproof and can be manufactured in a variety of colors from canvas or leather.

The plurality of pouches and/or holders 18 include a cigarette lighter, a gum or a lipstick holder 18-1, a snapable cigarette pouch 18-2, a snapable cosmetic makeup-up pouch 18-3, a flashlight holder 18-4, and a pen holder 18-5. Each of the plurality of pouches and/or holders 18 have a pouch and/or holder back loop 18-6.

The configuration of a first alternate embodiment of the pouch and/or holder back loop 18-6 can best be seen in FIG. 8, and as such, will be discussed therewith.

The pouch and/or holder back loop 18-6 has on its back side outer surface, a back loop outer surface strip of hook and loop fasteners 18-7 that is complementary to the belt strap with hook and loop fasteners 16-1 and engagable therewith.

The configuration of a second alternate embodiment of the pouch and/or holder back loop 18-6 can best be seen in FIG. 9, and as such, will be discussed therewith.

The pouch and/or holder back loop 18-6 has on its back side inner surface, a back loop inner surface strip of hook and loop fasteners 18-8 that is complementary to the pouch strap with hook and loop fasteners 16-2 and engagable therewith.

The configuration of a third alternate embodiment of the pouch and/or holder back loop 18-6 can best be seen in FIG. 10, and as such, will be discussed therewith.

The pouch and/or holder back loop 18-6 has both the back loop outer surface strip 18-7 and the back loop inner surface strip 18-8.

It is to be understood that the use of the cigarette lighter, the gum or the lipstick holder 18-1, the snapable cigarette pouch 18-2, the snapable cosmetic makeup-up pouch 18-3, the flashlight holder 18-4, and the pen holder 18-5 are for illustrative purposes only and that other pouches and/or holders can be utilized, such as but not limited to, a zippered tissue pouch, a beeper pouch, a change pouch, a wallet pouch, and/or a key chain holder.

Figure 3:
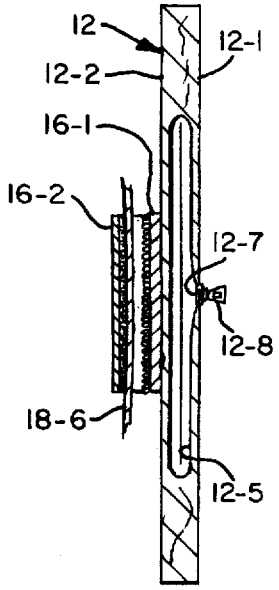
FIG. 3 is an enlarged cross sectional view with parts broken away, taken along line 3—3 of FIG. 2.
Figure 2:
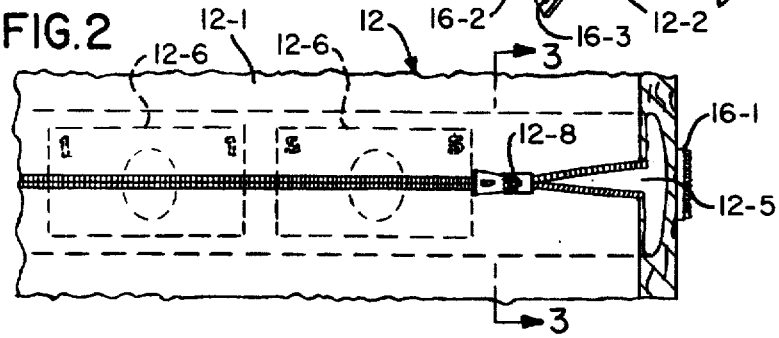
FIG. 2 is an enlarged diagrammatic elevational partial view taken in the area indicated by arrow 2 in FIG. 1.
Figure 4:
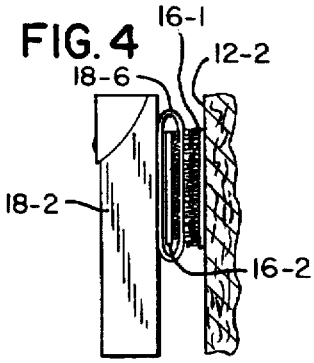
FIG. 4 is a diagrammatic elevational view partially sectioned taken along line 4—4 of FIG. 1.
Figure 5:
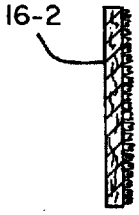
FIG. 5 is a cross sectional view taken along line 5—5 of FIG. 1.
Figure 6:
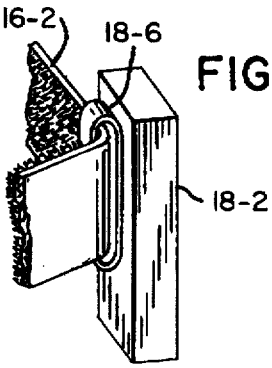
FIG. 6 is a diagrammatic perspective view of an embodiment of a typical component being installed on the belt of the instant invention.
Figure 7:
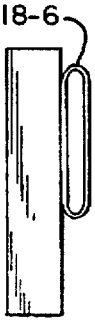
FIG. 7 is a diagrammatic side elevational view of a first arrangement for securing various components to the instant invention.

The configuration of the belt inner side zippered money pouch 12-5 can best be seen in FIGS. 2 and 3, and as such, will be discussed with reference thereto.

The belt inner side zippered money pouch 12-5 can receive paper money 12-6 by way of a belt inner side zippered money pouch slot 12-7. A plastic belt inner side zippered money pouch slot zipper 12-8 is disposed at the sides of the belt inner side zippered money pouch slot 12-7 and can close the belt inner side zippered money pouch slot 12-7 securing the paper money 12-6 therein.

In operation, the grabber tab 16-3 is grabbed and the pouch strap with hook and loop fasteners 16-2 is removed from engagement with the belt strap with hook and loop fasteners 16-1.

The pouch strap with hook and loop fasteners 16-2 is slipped through each pouch and/or holder back loop 18-6 of a respective one of the plurality of pouches and/or holders 18.

Figure 9:
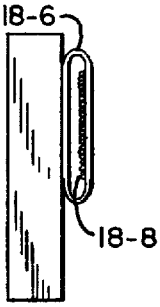
FIG. 9 is a diagrammatic side elevational view of a third arrangement for securing various components to the instant invention.
Figure 10:
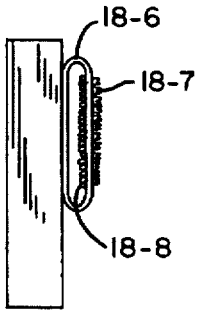
FIG. 10 is a diagrammatic side elevational view of a fourth arrangement for securing various components to the instant invention.

In the embodiments of FIGS. 9 and 10, the back loop inner surface strip of hook and loop fasteners 18-8 engages with the pouch strap with hook and loop fasteners 16-2 and is secured thereto further retaining the respective one of the plurality of pouches and/or holders 18 in the desired position.

The pouch strap with hook and loop fasteners 16-2 is reengaged with the belt strap with hook and loop fasteners 16-1.

Figure 8:
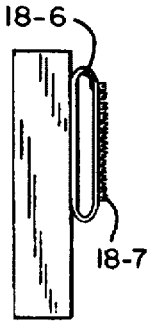
FIG. 8 is a diagrammatic side elevational view of a second arrangement for securing various components to the instant invention.

In the embodiments of FIGS. 8 and 10, the back loop outer surface strip of hook and loop fasteners 18-7 engages with the belt strap with hook and loop fasteners 16-1 and is secured thereto further retaining the respective one of the plurality of pouches and/or holders 18 in the desired position.

It will be understood that each of the elements described above, or two or more together, may also find a useful application in other types of constructions differing from the types described above.

While the invention has been illustrated and described as embodied in a multi-pouch belt, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A multi-pouch belt, comprising:

a) an elongated, slender, and rectangular-shaped belt having an inner side containing a pouch, an outer side, a first end, and a second end not overlapping said first end thereof when said multi-pouch belt is donned;

b) an elongated, slender, and rectangular-shaped belt strap being disposed on, and narrower than, said outer side of said elongated, slender, and rectangular-shaped belt and having an outer face with a loop portion of hook and loop fasteners disposed thereon; said elongated, slender, and rectangular-shaped belt strap extending along said outer side of said elongated, slender, and rectangular-shaped belt from before said first end thereof to before said second end thereof;

c) an elongated, slender, and rectangular-shaped pouch strap having a hook portion of said hook and loop fasteners disposed on an inner side thereof being releasibly engageable with said loop portion of said hook and loop fasteners on said outer side of said elongated, slender, and rectangular-shaped belt strap; said elongated, slender, and rectangular-shaped pouch strap having no hook and loop fasteners disposed on an outer side thereof and extending along said elongated, slender, and rectangular-shaped belt from before, and not extending past, said first end thereof to before, and not extending past, said second end thereof and having ends not overlapping each other when said multi-pouch belt is donned; and d) at least one pouch/holder removably mounted on said elongated, slender, and rectangular-shaped pouch strap and having a continuous loop disposed thereon for removably receiving said elongated, slender, and rectangular-shaped pouch strap; said continuous loop having a back side with an outer surface and an inner surface; said outer surface of said back side of said continuous loop having a hook portion of hook and loop fasteners disposed thereon being releasibly engageable with said loop portion of said hook and loop fasteners on said outer side of said elongated, slender, and rectangular-shaped belt strap; said inner surface of said back side of said continuous loop having a loop portion of hook and loop fasteners disposed thereon being releasibly engageable with said hook portion of said hook and loop fasteners on said inner side of said elongated, slender, and rectangular-shaped pouch strap.

2. The multi-pouch belt as defined in claim 1, wherein said at least one pouch/holder is selected from the group consisting of a cigarette lighter holder, a gum holder, a lipstick holder, a snapable cigarette pouch, a snapable cosmetic makeup-up pouch, a flashlight holder, a pen holder, a zippered tissue pouch, a beeper pouch, a change pouch, a wallet pouch, and a key chain holder.

3. The multi-pouch belt as defined in claim 1, wherein said pouch in said inner side of said belt contains a slot closable by a zipper.

4. The multi-pouch belt as defined in claim 3, wherein said zipper is plastic.

5. The multi-pouch belt as defined in claim 1; further comprising a tab disposed on at least one end of said pouch strap.

6. The multi-pouch belt as defined in claim 1, wherein said belt has properties selected from the group consisting of adjustable, waterproof, manufactured in a variety of colors, manufactured from canvas, and manufactured from leather.

7. The multi-pouch belt as defined in claim 1, wherein said at least one pouch/holder has properties selected from the group consisting of waterproof, manufactured in a variety of colors, manufactured from canvas, and manufactured from leather.

8. The multi-pouch belt as defined in claim 1; further comprising a buckle having a female portion disposed at said first end of said belt and a male portion disposed at said second end of said belt and being snapingly receivable by said female portion of said buckle.

9. The multi-pouch belt as defined in claim 8, wherein said female portion of said buckle and said male portion of said buckle are plastic.

10. A method of using a multi-pouch belt, comprising the steps of:

a) pulling an elongated, slender, and rectangular-shaped pouch strap of said multi-pouch belt which has an inner side with a hook portion of hook and loop fasteners disposed thereon away from an elongated, slender, and rectangular-shaped belt strap of said multi-pouch belt which has an outer face with a loop portion of said hook and loop fasteners thereon and being disposed on, and narrower than, an outer side of an elongated, slender, and rectangular-shaped belt of said multi-pouch pouch belt and extending therealong from before a first end thereof to before a second end thereof;

b) positioning each of at least one pouch/holder of said multi-pouch belt at a desired position on said outer side of said elongated, slender, and rectangular-shaped belt which has an inner side containing a pouch, a first end, and a second end not overlapping said first end thereof when said multi-pouch belt is donned;

c) engaging a hook portion of said hook and loop fasteners on an outer surface of a back side of a loop of each said at least one pouch/holder with said loop portion of said hook and loop fasteners on said outer face of said elongated, slender, and rectangular-shaped belt strap;

d) threading said elongated, slender, and rectangular-shaped pouch strap through said loop of each said at least one pouch/holder;

e) engaging a loop portion of said hook and loop fasteners on an inner surface of said back side of said loop of each said at least one pouch/holder with said hook portion of said hook and loop fasteners on said inner side of said elongated, slender, and rectangular-shaped pouch strap which has no hook and loop fasteners on an outer side thereof and extending along said elongated, slender, and rectangular-shaped belt from before, and not extending past, said first end thereof to before, and not extending past, said second end thereof and having ends not overlapping each other when said multi-pouch belt is donned; and f) engaging said hook portion of said hook and loop fasteners on said inner side of said elongated, slender, and rectangular-shaped pouch strap with said loop portion of said hook and loop fasteners on said outer face of said elongated, slender, and rectangular-shaped belt strap.

* * * * *